US011753769B2

(12) United States Patent
Nakamura et al.

(10) Patent No.: US 11,753,769 B2
(45) Date of Patent: Sep. 12, 2023

(54) SHEET MANUFACTURING METHOD AND SHEET MANUFACTURING APPARATUS

(71) Applicant: SEIKO EPSON CORPORATION, Tokyo (JP)

(72) Inventors: Masahide Nakamura, Nagano (JP); Yoshiyuki Nagai, Nagano (JP); Hideki Tanaka, Nagano (JP); Naoko Omagari, Nagano (JP); Yoko Nakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/656,906

(22) Filed: Mar. 29, 2022

(65) Prior Publication Data

US 2022/0316139 A1 Oct. 6, 2022

(30) Foreign Application Priority Data

Mar. 31, 2021 (JP) ..... 2021-059788

(51) Int. Cl.

| | |
|---|---|
| ***D21F 7/00*** | (2006.01) |
| ***D21F 11/02*** | (2006.01) |
| ***D21H 17/24*** | (2006.01) |
| ***D21H 23/04*** | (2006.01) |

(52) U.S. Cl.

CPC ..... *D21F 7/008* (2013.01); *D21F 11/02* (2013.01); *D21H 17/24* (2013.01); *D21H 23/04* (2013.01)

(58) Field of Classification Search

CPC ..... D21F 7/008; D21F 11/02; D21F 11/00; D21F 9/00; D21H 17/24; D21H 23/04; D21H 21/16; B27N 3/002; B27N 3/007; B27N 3/04

See application file for complete search history.

(56) References Cited

U.S. PATENT DOCUMENTS

| | | | | |
|---|---|---|---|---|
| 2003/0236511 | A1 | 12/2003 | Jones et al. | |
| 2014/0027075 | A1 | 1/2014 | Yamagami et al. | |
| 2015/0204015 | A1 | 7/2015 | Gomi et al. | |
| 2016/0230338 | A1 | 8/2016 | Nakamura et al. | |
| 2018/0080176 | A1* | 3/2018 | Higuchi | B27N 3/04 |

(Continued)

FOREIGN PATENT DOCUMENTS

| | | | |
|---|---|---|---|
| CN | 1675424 | A | 9/2005 |
| CN | 110894283 | A | 3/2020 |

(Continued)

*Primary Examiner* — Eric Hug

*Assistant Examiner* — Matthew M Eslami

(74) *Attorney, Agent, or Firm* — Global IP Counselors, LLP

(57) ABSTRACT

A sheet manufacturing method includes forming a web by accumulating a mixture containing a fiber and a water-soluble polysaccharide in a dry manner, a moisture imparting step of imparting the web with moisture, and a pressurizing and heating step of pressurizing and heating the web to which the moisture is imparted, in which the pressurizing and heating step performs pressurizing and heating at the same time, a pressure higher than a pressure applied to the web in the pressurizing and heating step is not applied to the web before the pressurizing and heating step, and heating to a temperature higher than a temperature for heating the web in the pressurizing and heating step is not performed before the pressurizing and heating step.

1 Claim, 2 Drawing Sheets

(56) References Cited

U.S. PATENT DOCUMENTS

| | | | | |
|---|---|---|---|---|
| 2019/0232606 | A1* | 8/2019 | Ota | D04H 1/54 |
| 2020/0080262 | A1 | 3/2020 | Sago et al. | |
| 2022/0097262 | A1 | 3/2022 | Nakai et al. | |

FOREIGN PATENT DOCUMENTS

| | | | |
|---|---|---|---|
| EP | 3 281 756 | A1 | 2/2018 |
| EP | 3 508 637 | A1 | 7/2019 |
| EP | 3 974 579 | A1 | 3/2022 |
| JP | 2012-144819 | A | 8/2012 |
| JP | 2015-066932 | A | 4/2015 |
| JP | 2015-137437 | A | 7/2015 |
| JP | 2020-016004 | A | 1/2020 |

* cited by examiner

SHEET MANUFACTURING METHOD AND SHEET MANUFACTURING APPARATUS

The present application is based on, and claims priority from JP Application Serial Number 2021-059788, filed Mar. 31, 2021, the disclosure of which is hereby incorporated by reference herein in its entirety.

BACKGROUND

1. Technical Field

The present disclosure relates to a sheet manufacturing method and a sheet manufacturing apparatus.

2. Related Art

A dry sheet manufacturing method has been proposed to manufacture a sheet such as paper with energy saving. For example, JP-A-2015-080853 describes a sheet manufacturing method including a web forming step of forming a web in which at least fibers and a resin are accumulated in air, a pressurizing step of pressurizing the web without heating, and a heating step of heating and pressurizing the web after the pressurizing step, in which the pressurizing force in the pressurizing step is greater than the pressurizing force in the heating and pressurizing step.

However, in order to manufacture a high-quality sheet by the sheet manufacturing method in related art, it is necessary to apply a high pressure to the web, and the size of the manufacturing apparatus becomes large.

SUMMARY

According to an aspect of the present disclosure, a sheet manufacturing method includes forming a web by accumulating a mixture containing a fiber and a water-soluble polysaccharide in a dry manner, a moisture imparting step of imparting the web with moisture, and a pressurizing and heating step of pressurizing and heating the web to which the moisture is imparted, in which the pressurizing and heating step performs pressurizing and heating at the same time, a pressure higher than a pressure applied to the web in the pressurizing and heating step is not applied to the web before the pressurizing and heating step, and heating to a temperature higher than a temperature for heating the web in the pressurizing and heating step is not performed before the pressurizing and heating step.

According to the present disclosure, a sheet manufacturing apparatus includes a mixing portion that mixes a fiber and a water-soluble polysaccharide to form a mixture, a web forming portion that forms a web by accumulating the mixture in a dry manner, a moisture imparting portion that imparts moisture to the web, and a pressurizing and heating portion that pressurizes and heats the web to which the moisture is imparted in the moisture imparting portion, in which the pressurizing and heating portion pressurizes and heats at the same time, a configuration in which a pressure higher than a pressure applied to the web in the pressurizing and heating portion is applied to the web, is not provided upstream of the pressurizing and heating portion in a moving direction of the web, and a configuration in which heating to a temperature higher than a temperature for heating the web in the pressurizing and heating portion is imparted to the web is not provided upstream of the pressurizing and heating portion in the moving direction of the web.

DESCRIPTION OF EXEMPLARY EMBODIMENTS

An embodiment of the present disclosure will be described below. The embodiments described below describe an example of the present disclosure. The present disclosure is not limited to the following embodiments, and includes various modifications implemented without changing the gist of the present disclosure. It should be noted that not all of the configurations described below are essential configurations of the present disclosure.

The sheet manufacturing method according to the present embodiment includes a step of forming a web by accumulating a mixture containing a fiber and a water-soluble polysaccharide in a dry manner, a moisture imparting step of imparting the web with moisture, and a pressurizing and heating step of pressurizing and heating the web to which the moisture is imparted. Hereinafter, an example of a sheet manufacturing apparatus capable of implementing the sheet manufacturing method of the present embodiment will be described, and then the sheet manufacturing method will be described.

1. Sheet Manufacturing Apparatus

Figure 1:
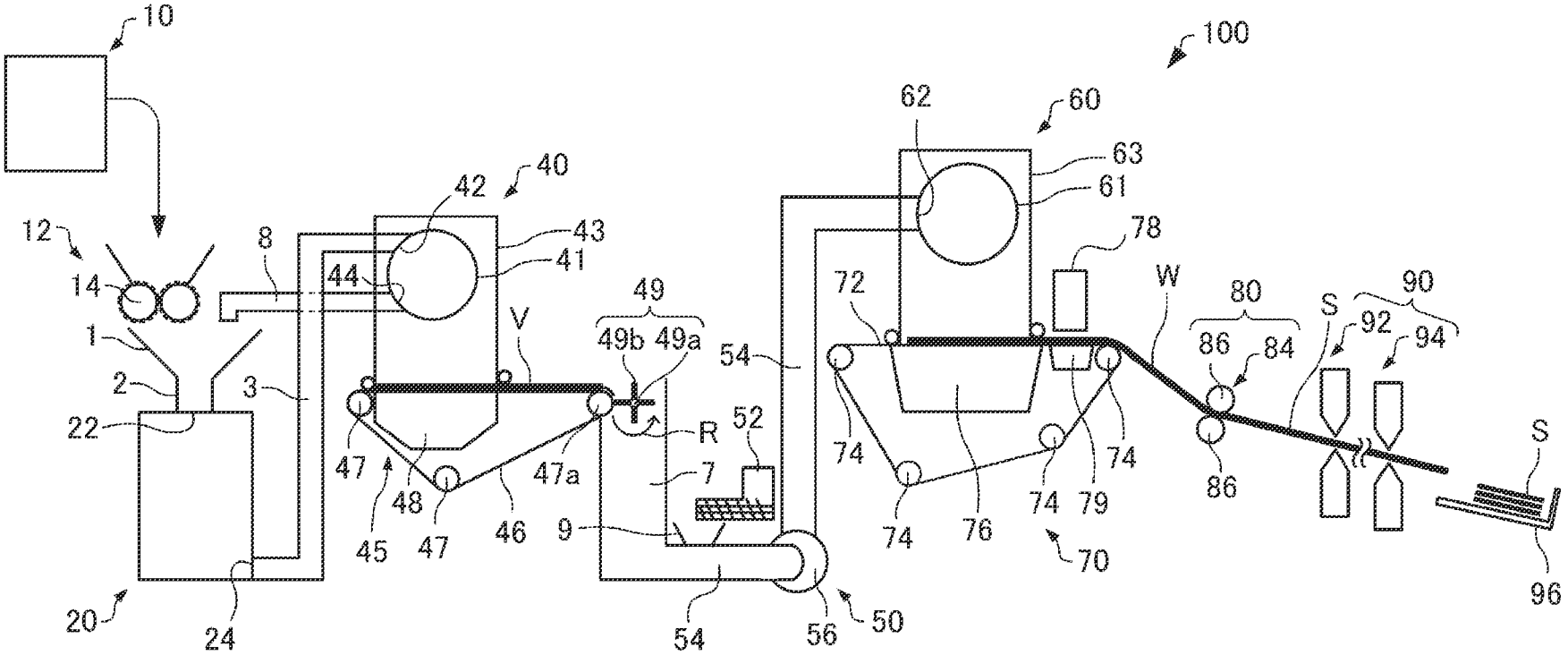
FIG. 1 is a diagram schematically illustrating a sheet manufacturing apparatus according to an embodiment.

An example of a sheet manufacturing apparatus capable of implementing a sheet manufacturing method of the present embodiment will be described with reference to the drawings. FIG. 1 is a diagram schematically illustrating a sheet manufacturing apparatus 100 according to the present embodiment.

As illustrated in FIG. 1, the sheet manufacturing apparatus 100 includes, for example, a supply portion 10, a coarse crushing portion 12, a defibrating portion 20, a sorting portion 40, a first web forming portion 45, a rotating body 49, a mixing portion 50, an accumulating portion 60, a second web forming portion 70, a sheet forming portion 80, and a cutting portion 90.

The supply portion 10 supplies the raw material to the coarse crushing portion 12. The supply portion 10 is, for example, an automatic charging portion for continuously charging the raw material into the coarse crushing portion 12. The raw material supplied by the supply portion 10 contains, for example, fibers such as used paper and pulp sheet.

The coarse crushing portion 12 cuts the raw material supplied by the supply portion 10 into small pieces in the air such as in the atmosphere. The shape and size of the small pieces are, for example, small pieces of several cm square. In the illustrated example, the coarse crushing portion 12 has a coarse crushing blade 14, and the charged raw material can be cut by the coarse crushing blade 14. As the coarse crushing portion 12, for example, a shredder is used. The raw material cut by the coarse crushing portion 12 is received by a hopper 1 and then transferred to the defibrating portion 20 via a pipe 2.

The defibrating portion 20 defibrates the raw material cut by the coarse crushing portion 12. Here, "defibrating" means unraveling a raw material formed by binding a plurality of fibers into individual fibers. The defibrating portion 20 also has a function of separating resin particles adhering to the raw material, and a substance such as ink, toner, and bleeding inhibitor from the fibers.

A product that has passed through the defibrating portion 20 is called a "defibrated product". In addition to the unraveled defibrated product fiber, the "defibrated product" may contain resin particles separated from the fiber when the fiber is unraveled, a coloring agent such as ink and toner, and an additive such as a bleeding preventive material and a paper strength enhancer. The shape of the unraveled defibrated product is string-like. The unraveled defibrated product may exist in a state in which it is not entangled with other unraveled fibers, that is, in an independent state, or may exist in a state in which it is entangled with other unraveled defibrated products to form a lump, that is, in a state of forming a lump.

The defibrating portion 20 performs defibration in a dry manner. Here, performing processing such as defibration in the air such as in the atmosphere, not in a liquid, is referred to as a dry manner. As the defibrating portion 20, for example, an impeller mill is used. The defibrating portion 20 has a function of sucking the raw material and generating an air flow that discharges the defibrated product. As a result, the defibrating portion 20 can suck the raw material together with the air flow from an introduction port 22 by the air flow generated by itself, perform the defibration processing, and transport the defibrated product to a discharge port 24. The defibrated product that has passed through the defibrating portion 20 is transferred to the sorting portion 40 via a pipe 3. As the air flow for transporting the defibrated product from the defibrating portion 20 to the sorting portion 40, the air flow generated by the defibrating portion 20 may be used, or an air flow generation apparatus such as a blower may be provided to use the air flow thereof.

The sorting portion 40 introduces the defibrated product defibrated by the defibrating portion 20 from the introduction port 42 and sorts the fibers according to the length of the fibers. The sorting portion 40 has, for example, a drum portion 41 and a housing portion 43 that houses the drum portion 41. As the drum portion 41, for example, a sieve is used. The drum portion 41 has a net and can perform separation into the first sorted product that is fibers or particles smaller than the size of the net opening of the net, that is, that pass through the net, and the second sorted product that is fibers, un-defibrated pieces, or lumps larger than the size of the net opening of the net, that is, that do not pass through the net. For example, the first sorted product is transferred to the accumulating portion 60 via the pipe 7. The second sorted product is returned from the discharge port 44 to the defibrating portion 20 via the pipe 8. Specifically, the drum portion 41 is a cylindrical sieve that is rotationally driven by a motor. As the net of the drum portion 41, for example, a wire net, an expanded metal obtained by stretching a metal plate having a cut, or a punching metal in which a hole is formed in the metal plate by a press machine or the like is used.

The first web forming portion 45 transports the first sorted product that has passed through the sorting portion 40 to the pipe 7. The first web forming portion 45 has, for example, a mesh belt 46, a tension roller 47, and a suction mechanism 48.

The suction mechanism 48 can suck the first sorted product dispersed in the air by passing through the opening of the sorting portion 40 onto the mesh belt 46. The first sorted product is accumulated on the moving mesh belt 46 to form a web V. The basic configuration of the mesh belt 46, the tension roller 47, and the suction mechanism 48 is the same as that of a mesh belt 72, a tension roller 74, and a suction mechanism 76 of a second web forming portion 70, which will be described later.

By passing through the sorting portion 40 and the first web forming portion 45, the web V is formed in a soft and bulging state containing a large amount of air. The web V accumulated on the mesh belt 46 is charged into the pipe 7 and transported to the accumulating portion 60.

The rotating body 49 can cut the web V. In the illustrated example, the rotating body 49 has a base portion 49*a* and a protrusion 49*b* protruding from the base portion 49*a*. The protrusion 49*b* has, for example, a plate-like shape. In the illustrated example, the four protrusions 49*b* are provided, and the four protrusions 49*b* are provided at equal intervals. The base portion 49*a* rotates in a direction R, and thus the protrusion 49*b* can rotate about the base portion 49*a* as an axis. By cutting the web V by the rotating body 49, for example, the fluctuation of the amount of defibrated product per unit time supplied to the accumulating portion 60 can be reduced.

The rotating body 49 is provided in the vicinity of the first web forming portion 45. In the illustrated example, the rotating body 49 is provided in the vicinity of the tension roller 47*a* positioned downstream in the path of the web V. The rotating body 49 is provided at a position at which the protrusion 49*b* can come into contact with the web V and at a position at which the protrusion 49*b* does not come into contact with the mesh belt 46 on which the web V is accumulated. As a result, it is possible to suppress the mesh belt 46 from being worn by the protrusion 49*b*. The shortest distance between the protrusion 49*b* and the mesh belt 46 is, for example, 0.05 mm or more and 0.5 mm or less. This is the distance at which the web V can be cut without the mesh belt 46 being damaged.

The mixing portion 50 mixes, for example, the first sorted product that has passed through the sorting portion 40 and the additive. The mixing portion 50 has, for example, an additive supply portion 52 for supplying the additive, a pipe 54 for transporting the first sorted product and the additive, and a blower 56. In the illustrated example, the additive is supplied from the additive supply portion 52 to the pipe 54 via the hopper 9. The pipe 54 is continuous with the pipe 7.

In the mixing portion 50, an air flow is generated by the blower 56, and the first sorted product and the additive can be transported while being mixed in the pipe 54. The mechanism for mixing the first sorted product and the additive is not particularly limited, and may be one stirred by blades rotating at high speed, or may one using the rotation of the container like a V-type mixer.

As the additive supply portion 52, a screw feeder as illustrated in FIG. 1 or a disc feeder (not illustrated) or the like is used.

The additive supplied from the additive supply portion 52 is not particularly limited, and may include, for example, a material for binding a plurality of fibers. Further, when the sheet manufacturing method of the present embodiment is applied, the additive contains a water-soluble polysaccharide. The water-soluble polysaccharide will be described later.

When the additive supplied from the additive supply portion 52 contains a material for binding a plurality of fibers, the plurality of fibers are not bound at the time when the additive is supplied. Examples of the material for binding a plurality of fibers include acrylonitrile styrene (AS) resin, acrylonitrile butadiene styrene (ABS) resin, polypropylene, polyethylene, polyvinyl chloride, polystyrene, acrylic resin, polyester, polyethylene terephthalate, polyphenylene ether, polybutylene terephthalate, nylon, polyamide, polycarbonate, polyacetal, polyphenylene sulfide, polyether ether ketone, or the like. These materials may be used alone or in admixture. The additive supplied from the additive supply portion 52 may be in the form of fibers or in the form of powder.

The additives supplied from the additive supply portion 52 may include a colorant for coloring the fibers, an aggregation suppressant for suppressing the aggregation of the fibers and the aggregation of the additives, and a flame retardant for making fibers or the like hard to burn, depending on the type of the sheet to be manufactured. The mixture that has passed through the mixing portion 50 is transferred to the accumulating portion 60 via the pipe 54.

The accumulating portion 60 introduces the mixture that has passed through the mixing portion 50 from the introduction port 62, loosens the entangled defibrated product, and drops the product while dispersing the product in the air. As a result, the accumulating portion 60 can uniformly accumulate the mixture on the second web forming portion 70.

The accumulating portion 60 has, for example, a drum portion 61 and a housing portion 63 that houses the drum portion 61. As the drum portion 61, a rotating cylindrical sieve is used. The drum portion 61 has a net and allows fibers or particles smaller than the size of the net opening of the net contained in the mixture that has passed through the mixing portion 50 to drop. The configuration of the drum portion 61 is, for example, the same as the configuration of the drum portion 41.

The "sieve" of the drum portion 61 may not have a function of sorting a specific object. That is, the "sieve" used as the drum portion 61 means that the drum portion 61 is provided with a net, and the drum portion 61 may drop all of the mixture introduced into the drum portion 61.

The second web forming portion 70 accumulates the passing object that has passed through the accumulating portion 60 to form the web W. The second web forming portion 70 has, for example, a mesh belt 72, a tension roller 74, and a suction mechanism 76.

The passing object that has passed through the opening of the accumulating portion 60 is accumulated on the mesh belt 72. The mesh belt 72 is stretched by the tension roller 74, and has a configuration that allows air to pass through, which makes it difficult for the passing object to pass through. The mesh belt 72 moves by rotating the tension roller 74. The web W is formed on the mesh belt 72 by continuously accumulating the passing object that has passed through the accumulating portion 60 when the mesh belt 72 continuously moves.

The suction mechanism 76 is provided below the mesh belt 72. The suction mechanism 76 can generate a downward air flow. The mixture dispersed in the air by the accumulating portion 60 can be sucked onto the mesh belt 72 by the suction mechanism 76. As a result, the discharge rate from the accumulating portion 60 can be increased. Further, the suction mechanism 76 can form a downflow in the fall path of the mixture, and can prevent the defibrated products and the additive from being entangled during the fall.

As described above, by passing through the accumulating portion 60 and the second web forming portion 70, the web W is formed in a soft and bulging state containing a large amount of air.

Moisture is imparted to the accumulated web W when being transported to the sheet forming portion 80. Moisture is imparted by the moisture imparting portion 78. The moisture imparting portion 78 imparts moisture for the web W to have a predetermined water content, and can be configured by, for example, water vapor, mist, shower, ink jet, or the like. Of these, it is more preferable that the moisture imparting portion 78 imparts water to the web W by vapor or mist from a viewpoint that moisture can be imparted to the web W with good uniformity.

Further, in the illustrated example, the suction mechanism 79 is provided at an opposite position of the moisture imparting portion 78 with the web W interposed therebetween. The suction mechanism 79 can generate a downward air flow. The moisture generated from the moisture imparting portion 78 can be passed through the web W to be sucked by the suction mechanism 79. As a result, moisture can be imparted more evenly in the thickness direction of the web W. In the illustrated example, moisture is imparted to the web W on the mesh belt 72 from the moisture imparting portion 78, but the moisture imparting portion 78 may be provided at a position at which the web W is not transported to the sheet forming portion 80.

The web W to which the moisture is imparted by the moisture imparting portion 78 is transported to the sheet forming portion 80.

The sheet forming portion 80 forms the sheet S by pressurizing and heating the web W accumulated on the mesh belt 72. The sheet forming portion 80 applies heat and pressure to a mixture of a defibrated product and an additive that are mixed, accumulated, and imparted with moisture. In the sheet forming portion 80, the moisture evaporates after the temperature rises, and the thickness of the web W becomes smaller to increase the density. The temperature of the moisture and the water-soluble polysaccharide rises due to heat, and the density increases due to the pressure, so that the water-soluble polysaccharide gelatinizes, and then the moisture evaporates to bind a plurality of fibers via the gelatinized water-soluble polysaccharide. As a result, the sheet S having good mechanical strength can be formed. Further, the moisture evaporates due to heat and the density increases due to pressure, so that a plurality of fibers may be bound by hydrogen bonds. As a result, the sheet S having better mechanical strength can be formed.

The sheet forming portion 80 has a pressurizing and heating portion 84 that pressurizes and heats the web W. The pressurizing and heating portion 84 can be configured by using, for example, a heating roller or a heat press molding machine. In the illustrated example, the pressurizing and heating portion 84 is a pair of heating rollers 86. The number of heating rollers 86 is not particularly limited. The pressurizing and heating portion 84 can pressurize and heat the web W at the same time. The sheet manufacturing apparatus 100 does not apply a pressure higher than the pressure applied to the web W by the pressurizing and heating portion 84 to the web W before the web W is transported to the pressurizing and heating portion 84. Further, the sheet manufacturing apparatus 100 does not heat the web W to a temperature higher than the temperature at which the web W is heated by the pressurizing and heating portion 84 before the web W is transported to the pressurizing and heating portion 84.

The cutting portion 90 cuts the sheet S formed by the sheet forming portion 80. In the illustrated example, the cutting portion 90 includes a first cutting portion 92 that cuts the sheet S in a direction intersecting the transport direction of the sheet S, and a second cutting portion 94 that cuts the sheet S in a direction parallel to the transport direction. The second cutting portion 94 cuts, for example, the sheet S that has passed through the first cutting portion 92.

As a result, the sheet S of a single form having a predetermined size is formed. The cut sheet S of a single form is discharged to the discharge receiving portion 96.

2. Sheet Manufacturing Method

Figure 2:
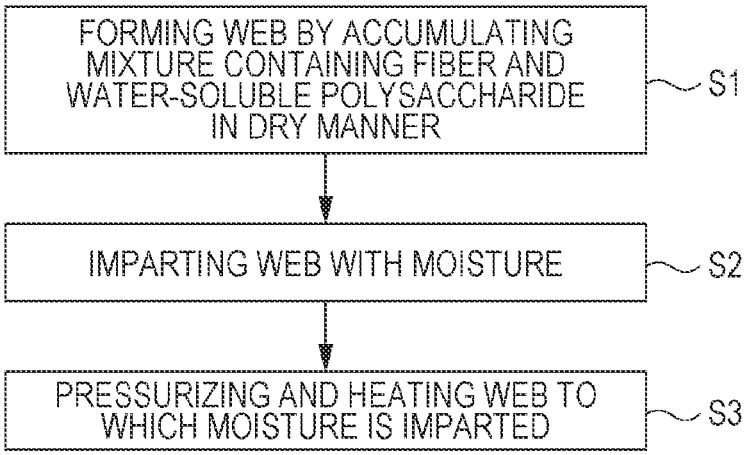
FIG. 2 is a flowchart for explaining a sheet manufacturing method according to an embodiment.

Next, the sheet manufacturing method according to the present embodiment will be described with reference to the drawings. FIG. 2 is a flowchart for explaining the sheet manufacturing method according to the present embodiment. The sheet manufacturing method according to the present embodiment can be performed using, for example, the sheet manufacturing apparatus 100 described above. The sheet S manufactured by the sheet manufacturing apparatus 100 is a sheet containing at least fibers and the water-soluble polysaccharide.

As illustrated in FIG. 2, the sheet manufacturing method according to the present embodiment includes a step of forming a web by accumulating a mixture containing a fiber and a water-soluble polysaccharide in a dry manner (step S1), a moisture imparting step of imparting the web with moisture (step S2), and a pressurizing and heating step of pressurizing and heating the web to which the moisture is imparted (step S3).

2.1. Fiber

The fiber is not particularly limited, and a wide range of fiber materials can be used. Examples of the fiber can include natural fiber (animal fiber, plant fiber), chemical fiber (organic fiber, inorganic fiber, organic-inorganic composite fiber), or the like. More specifically, examples of the fiber may be fiber or the like made of cellulose, silk, wool, cotton, cannabis, kenaf, flax, ramie, jute, Manila hemp, sisal hemp, coniferous trees, broadleaf trees, or the like, and these may be used alone, may be appropriately mixed and used, or may be used as a recycled fiber treated with purification or the like.

Examples of the raw materials of the fiber include pulp, used paper, used cloth, or the like. Further, the fiber may be subjected to various surface treatments. Further, the material of the fiber may be a pure substance or may be a material containing a plurality of components such as impurities and other components. Further, as the fiber, a defibrated product obtained by defibrating used paper, pulp sheet or the like in a dry manner may be used.

The length of the fiber is not particularly limited, but in one independent fiber, the length along the longitudinal direction of the fiber is 1 μm or more and 5 mm or less, preferably 2 μm or more and 3 mm or less, more preferably 3 μm or more and 2 mm or less.

Since the sheet manufacturing method of the present embodiment includes a moisture imparting step, the mechanical strength of the formed sheet can be increased by using fibers having the ability to form hydrogen bonds. Examples of such fibers include cellulose.

The fiber content in the sheet is, for example, 50% by mass or more and 99.9% by mass or less, preferably 60% by mass or more and 99% by mass or less, and more preferably 70% by mass or more and 99% by mass or less. Such a content can be obtained by performing blending when forming the mixture.

2.2. Water-Soluble Polysaccharide

The water-soluble polysaccharide refers to a polysaccharide that dissolves in water, hot water, or boiling water. Specific examples of the water-soluble polysaccharide can include starch and dextrin.

Starch is a polymer in which a plurality of a-glucose molecules are polymerized by glycosidic bonds. The starch may be linear or may contain branches.

As the starch, those derived from various plants can be used. Examples of the raw materials for starch include grains such as corn, wheat, and rice, beans such as broad beans, mung beans, and red beans, potatoes such as taros, sweet potatoes, and tapioca, wild grasses such as katakuri, warabi, and kudzu, and palms such as sago palm.

Further, processed starch or modified starch may be used as the starch. Examples of the processed starch include acetylated adipic acid cross-linked starch, acetylated starch, oxidized starch, sodium octenyl succinate, hydroxypropyl starch, hydroxypropylated phosphoric acid cross-linked starch, phosphorylated starch, phosphoric acid esterified phosphoric acid cross-linked starch, urea phosphorylated esterified starch, starch sodium glycolate, high amylose corn starch, or the like. Further, examples of the modified starch include pregelatinized starch, dextrin, lauryl polyglucose, cationized starch, thermoplastic starch, carbamic acid starch, or the like. As the dextrin, those obtained by processing or modifying starch can be preferably used.

By using a water-soluble polysaccharide in the sheet manufacturing method, at least one of the gelatinization of the water-soluble polysaccharide and the hydrogen bonds due to the water-soluble polysaccharide is generated by performing pressurizing and heating after moisture is imparted, so that the sheet can have sufficient strength.

The content of the water-soluble polysaccharide in the sheet is, for example, 0.1% by mass or more and 50% by mass or less, preferably 1% by mass or more and 40% by mass or less, and more preferably 1% by mass or more and 30% by mass or less. Such a content can be obtained by performing blending when forming the mixture.

2.3. Step of Forming Web

The step of forming a web is to accumulate a mixture containing a fiber and a water-soluble polysaccharide in a dry manner to form a web. When the above-mentioned sheet manufacturing apparatus 100 is used, the fiber is a defibrated product defibrated by the defibrating portion 20, the water-soluble polysaccharide is supplied from the additive supply portion 52, and the mixture is formed by the mixing portion 50. Then, the accumulating portion 60 and the second web forming portion 70 can accumulate the mixture in a dry manner to form a web.

2.4. Moisture Imparting Step

In the moisture imparting step, the web is imparted with moisture. When the above-mentioned sheet manufacturing apparatus 100 is used, moisture can be imparted to the web W by the moisture imparting portion 78.

The amount of water imparted in the moisture imparting step can be managed by, for example, the water content of the web. The water content of the web to which the moisture is imparted in the moisture imparting step is preferably 12% by mass or more and 40% by mass or less, more preferably 13% by mass or more and 30% by mass or less, and further preferably 14% by mass or more and 25% by mass or less. When the imparting amount of moisture is approximately this level, it is possible to manufacture a sheet having higher strength when suppressing the amount of energy such as electric power required to heat and dry the web.

Further, in the moisture imparting step, it is preferable that water vapor or mist is imparted to the web. In this way, the web can be more evenly imparted with moisture, and the sheet can be manufactured with a simpler apparatus configuration.

In the moisture imparting step, components other than water may be imparted to the web using an aqueous solution or the like. On the other hand, it is more preferable that the moisture imparted to the web in the moisture imparting step does not contain a water-soluble polysaccharide. The water-soluble polysaccharide may increase the viscosity of water, and since the moisture to be imparted does not contain the water-soluble polysaccharide, the increase in the viscosity of the moisture can be suppressed. As a result, it is possible to suppress clogging when there is a nozzle or the like in the moisture imparting portion, or to impart moisture to the web with a simpler configuration.

2.5. Pressurizing and Heating Step

In the pressurizing and heating step, the web to which the moisture is imparted is pressurized and heated. In the pressurizing and heating step, pressurizing and heating are performed at the same time. The pressurizing and heating step can be performed by the sheet forming portion 80 when the above-mentioned sheet manufacturing apparatus 100 is used.

The pressurizing and heating step applies pressure to the web, thins the web, and increases the density of the web. The pressure applied to the web by the pressurizing and heating step is preferably 0.1 MPa or more and 15 MPa or less, more preferably 0.2 MPa or more and 10 MPa or less, and further preferably 0.3 MPa or more and 5 MPa or less. When the pressure applied to the web in the pressurizing and heating step is within such a range, deterioration of the fiber can be suppressed, and it is possible to manufacture a sheet that allows a sheet having good strength to be manufactured again using the defibrated product obtained by defibrating the manufactured sheet as a raw material. Further, since the apparatus configuration for pressurizing and heating can be reduced, a sheet can be manufactured using a smaller apparatus.

In the pressurizing and heating step, heat is applied to the web to evaporate the moisture contained in the web. In the pressurizing and heating step, the temperature of the web is heated to preferably 50° C. or higher and 105° C. or lower, more preferably 60° C. or higher and 100° C. or lower, and further preferably 70° C. or higher and 98° C. or lower. By doing so, the time required for the pressurizing and heating step can be reduced, and the sheet can be manufactured with lower energy.

In the pressurizing and heating step, a relatively low pressure is applied to the web, so a small manufacturing apparatus can be used, and since the damage to the fiber is relatively small, it is possible to manufacture a sheet that allows a sheet to be easily manufactured by defibration again.

Further, in the pressurizing and heating step, since the web is heated to a relatively low temperature, it is easy to form hydrogen bonds between the fibers and it is easy to secure the strength of the sheet. Further, since the water-soluble polysaccharide can be gelatinized, the strength of the sheet can be obtained also from the fact that the bind of fibers can be generated by the water-soluble polysaccharide.

In the sheet manufacturing method of the present embodiment, a pressure higher than a pressure applied to the web in the pressurizing and heating step is not applied to the web before the pressurizing and heating step. By doing so, a small apparatus can be used, and a sheet that is easy to be recycled can be manufactured.

Further, in the sheet manufacturing method of the present embodiment, heating to a temperature higher than a temperature for heating the web in the pressurizing and heating step is not performed before the pressurizing and heating step. By doing so, a sheet having good strength can be manufactured.

Accordingly, the sheet manufacturing apparatus performing the sheet manufacturing method of the present embodiment includes a mixing portion that mixes a fiber and a water-soluble polysaccharide to form a mixture, a web forming portion that forms a web by accumulating the mixture in a dry manner, a moisture imparting portion that imparts moisture to the web, and a pressurizing and heating portion that pressurizes and heats the web to which the moisture is imparted in the moisture imparting portion, in which the pressurizing and heating portion pressurizes and heats at the same time, a configuration in which a pressure higher than a pressure applied to the web in the pressurizing and heating portion is applied to the web, is not provided upstream of the pressurizing and heating portion in a moving direction of the web, and a configuration in which heating to a temperature higher than a temperature for heating the web in the pressurizing and heating portion is imparted to the web is not provided upstream of the pressurizing and heating portion in the moving direction of the web.

Here, "upstream of the pressurizing and heating portion in the moving direction of the web" means that in the above-mentioned sheet manufacturing apparatus 100, it refers to a portion in which the web W moves to the pressurizing and heating portion 80 after the web W is formed by the second web forming portion 70.

2.6. Other Steps

The sheet manufacturing method of the present embodiment may include, for example, a defibrating step, a sorting step, a cutting step, or the like, in addition to the above-mentioned steps. By using the above-mentioned sheet manufacturing apparatus 100, these steps can be easily performed by the defibrating portion 20, the sorting portion 40, the first web forming portion 45, the rotating body 49, the cutting portion 90, or the like.

2.7. Action Effect

According to the sheet manufacturing method of the present embodiment, by imparting moisture to the web containing the water-soluble polysaccharide and then pressurizing and heating the sheet at the same time, the sheet can be manufactured at a lower pressure and a lower temperature, and the manufacturing apparatus can be miniaturized. Further, according to the sheet manufacturing method, by using a water-soluble polysaccharide, it is possible to manufacture a sheet in which a recycled sheet can be easily manufactured. Further, according to the sheet manufacturing method, the amount of water used can be reduced as compared with the wet papermaking method by forming a web by accumulating the mixture in a dry manner.

3. EXAMPLE AND COMPARATIVE EXAMPLE

Hereinafter, the present disclosure will be described in more detail with reference to Examples, but the present disclosure is not limited to these examples. Hereinafter, "%" is based on mass unless otherwise specified.

3.1. Example

Heating at the Same Time of Pressurizing

As the starch (water-soluble polysaccharide), Rastergen FK manufactured by Nissho Chemical Co., Ltd. is used. 22.5 g of hardwood bleached kraft pulp was weighed and placed in a clean polyethylene wide-mouthed ointment bottle (capacity 1000 ml) and covered. The rotation speed of the ball mill rotary stand was adjusted so that the peripheral speed of the bottle would be 15 m/min when the bottle was mounted, and the ball mill was rotated for 8 minutes. The obtained fiber was taken out from the bottle, put into a plastic bag, 7.5 g of starch was further put into the plastic bag, and the mixture was stirred while blowing air into the plastic bag with an air gun. The resulting mixture was taken out avoiding vibration and air flow as much as possible, sieved, and accumulated on aluminum foil to form a web. The web was imparted with water by spraying up to a moisture content of 20%. Then, a sheet of the example was prepared by passing the web through a heating roller together with the aluminum foil so that the temperature of the web was 85° C. at a pressure of 0.5 MPa and then peeling off the aluminum foil.

With respect to the sheet of the example, a sheet piece having a size of 30 mm×200 mm was cut out, the thickness and mass of the sheet piece were measured, and the density was calculated from the following equation (1). The thickness was obtained by measuring 5 places on the sheet piece with a micrometer to calculate the average value.

$$\text{density}(g/cm^3)=\text{mass}(g)/[\text{thickness}(cm)\times 3\ cm\times 20\ cm] \quad (1)$$

The sheet density of the example was 0.65 $g/cm^3$.

Further, a sheet piece having a width of 10 mm and a length of 50 mm was cut out from the produced sheet, and a specific tensile strength (strength) was obtained based on the following equation (2). The specific tensile strength was evaluated by a tensile test. As the test apparatus, "AGS-X500N" manufactured by Shimadzu Corporation was used. The tensile speed was 1 mm/s.

$$\text{specific tensile strength}(N\cdot m/g)=\text{maximum tensile load}(N)/\text{sheet piece width}(mm)/\text{sheet piece basis weight}\ (g/cm^2) \quad (2)$$

The strength of the sheet of the example was 29 N·m/g.

As described above, the sheet of the example had good density and strength. When pressurizing and heating are performed at the same time, it is considered that a sheet of good quality can be obtained since two points are well performed such as (1) since the sheet is compressed and the density increases, the distance between the fibers and between the fibers and the starch becomes close, and (2) the starch is gelatinized and the fibers are adhered by the gelatinized starch.

Further, by imparting moisture to the sheet before entering the heating roller (before entering the nip), the pulp fibers absorb moisture, and the hydrogen bonds of the cellulose constituting the pulp fibers are loosened, so that it is considered that the pulp fibers become flexible. By applying pressure to the sheet in this state, it was possible to compress the sheet more easily than when no moisture is imparted, and the required density was obtained without applying high pressure. Further, when the fibers are kept flexible and compressed at a low pressure, the pulp fibers are less likely to be broken, and it is considered that the strength of the fibers can be easily maintained although repeated recycle is performed.

In general, starch is gelatinized by putting the starch in water and stirring the starch when heating. Gelatinization is a state where water molecules enter the starch molecular chain and the molecular structure of starch is loosened. The gelatinization temperature differs depending on the type of starch, and mostly is around 60° C. to 80° C. Accordingly, it takes several minutes to several tens of minutes to gelatinize the starch by a general method.

However, in the method of the example, gelatinization of starch could be performed in a short time (several seconds or less). In the method of the example, it is considered that the starch gelatinizes in the process of applying heat to the web (mixture of pulp and powder starch) containing water in the roller nip, but it is considered that it is effective to apply pressure at the same time as heat at the nip. The detailed mechanism of this is unknown, but it is considered that when the temperature of the starch particles and water rises in the nip, the pressure is applied at the same time, so that the invasion of water into the molecule is promoted by pressure and gelatinization is expected to progress in a short time.

In the nip, since the sheet (web) is sufficiently compressed to be in a state where the fibers and the fibers and the starch are close to each other, the gelatinized starch adheres the fibers to each other. Since the sheet is adhered by starch when the sheet is discharged from the nip, it is considered that spring-back did not occur although the pressure was released exiting from the nip and a high density could be maintained.

3.2. Comparative Example 1

A web was formed on the aluminum foil in the same manner as in the example. Then, the web was passed through a pressurizing roller together with the aluminum foil at a pressure of 0.5 MPa without heating. Further, the sheet of the comparative example 1 was prepared by passing the web through a heating roller together with the aluminum foil to have a temperature of 85° C. and then peeling off the aluminum foil. The pressure by the heating roller was 0.14 MPa.

The sheet density of the comparative example 1 was 0.54 $g/cm^2$. Further, when the strength was measured in the same manner as in the example, the strength of the sheet of the comparative example 1 was 14 N·m/g.

The web imparted with moisture is well compressed by the nip of the pressurizing roller. However, in the comparative example 1, since heat was not applied at this point and the starch was not gelatinized, it is considered that the starch has no adhesive effect. Accordingly, it is considered that a slight spring-back occurs when exiting the nip of the pressurizing roller and the obtained density is lower than that in the example.

Further, in the comparative example 1, it is considered that the starch was gelatinized to some extent by applying heat at the nip of the heating roller. However, in the comparative example 1, since the pressure applied by the heating roller is small, there is no effect of promoting gelatinization by the pressure. Accordingly, it is considered that the degree of gelatinization of starch was low and a sufficient adhesive effect could not be obtained.

3.3. Comparative Example 2

A web was formed on the aluminum foil in the same manner as in the example. Then, the web was passed through a heating roller together with the aluminum foil so that the temperature was 85° C. at a pressure of 0.14 MPa. Further, the sheet of the comparative example 2 was prepared by passing the web together with the aluminum foil through a pressurizing roller at a pressure of 0.5 MPa without heating and then peeling off the aluminum foil.

The sheet density of the comparative example 2 was 0.39 g/cm$^2$. Further, when the strength was measured in the same manner as in the example, the strength of the sheet of the comparative example 2 was 7 N·m/g.

In the comparative example 2, it is considered that the starch is gelatinized to some extent by applying temperature at the nip of the heating roller. However, the degree of gelatinization of starch is low because there is no effect of promoting gelatinization by pressure. Further, in the comparative example 2, since the pressure of the nip of the heating roller is low, the compression of the sheet (web) is weak, and the distance between the fibers and the distance between the fibers and the starch are not so close. Accordingly, it is considered that the adhesive effect was insufficient.

Further, in the comparative example 2, the same pressure as in the example was imparted by the pressurizing roller, but since the sheet was dried by the heating roller in the previous stage, the flexibility of the pulp was low and compression was difficult. Accordingly, the obtained density was low. Further, the obtained strength was extremely low, which is presumed to be that the adhesion point on the heating roller in the previous stage was destroyed by compression.

The embodiment and the modification example described above are merely examples, and the present disclosure is not limited thereto. For example, each embodiment and each modification example can be combined as appropriate.

The present disclosure includes a configuration substantially the same as the configuration described in the embodiment, for example, a configuration having the same function, method and result, or a configuration having the same purpose and effect. The present disclosure also includes a configuration in which a non-essential part of the configuration described in the embodiment is replaced. Further, the present disclosure includes a configuration that exhibits the same action effect as the configuration described in the embodiment or a configuration that can achieve the same object. Further, the present disclosure includes a configuration in which a technique in related art is added to the configuration described in the embodiment.

The following contents are derived from the embodiment described above and the modification example.

The sheet manufacturing method includes forming a web by accumulating a mixture containing a fiber and a water-soluble polysaccharide in a dry manner, a moisture imparting step of imparting the web with moisture, and a pressurizing and heating step of pressurizing and heating the web to which the moisture is imparted, in which the pressurizing and heating step performs pressurizing and heating at the same time, a pressure higher than a pressure applied to the web in the pressurizing and heating step is not applied to the web before the pressurizing and heating step, and heating to a temperature higher than a temperature for heating the web in the pressurizing and heating step is not performed before the pressurizing and heating step.

According to the sheet manufacturing method, it is not necessary to apply high pressure to the web, and a small manufacturing apparatus can be used. That is, according to the sheet manufacturing method, by imparting moisture to the web containing the water-soluble polysaccharide and then pressurizing and heating the sheet at the same time, the sheet can be manufactured at a lower pressure and a lower temperature, and the manufacturing apparatus can be miniaturized. Further, according to the sheet manufacturing method, by using a water-soluble polysaccharide, it is possible to manufacture a sheet in which a recycled sheet can be easily manufactured. Further, according to the sheet manufacturing method, the amount of water used can be reduced as compared with the wet papermaking method by forming a web by accumulating the mixture in a dry manner.

In the above sheet manufacturing method, the water content of the web to which the moisture is imparted in the moisture imparting step may be 12% by mass or more and 40% by mass or less.

According to the sheet manufacturing method, it is possible to manufacture a sheet having higher strength when suppressing the amount of energy such as electric power required to heat and dry the web.

In the above sheet manufacturing method, the pressure applied to the web in the pressurizing and heating step may be 0.2 MPa or more and 10 MPa or less.

According to the sheet manufacturing method, deterioration of the fiber can be suppressed, and it is possible to manufacture a sheet that allows a sheet having good strength to be manufactured again using the defibrated product obtained by defibrating the manufactured sheet as a raw material. Further, since the apparatus configuration for pressurizing and heating can be reduced, a sheet can be manufactured using a smaller apparatus.

In the above sheet manufacturing method, the temperature of the web in the pressurizing and heating step may be 60° C. or higher and 100° C. or lower.

According to the sheet manufacturing method, the time required for the pressurizing and heating step can be reduced, and the sheet can be manufactured with lower energy.

In the above sheet manufacturing method, in the moisture imparting step, water vapor or mist may be imparted to the web.

According to the sheet manufacturing method, the web can be more evenly imparted with moisture, and the sheet can be manufactured with a simpler apparatus configuration.

In the above sheet manufacturing method, the moisture imparted to the web in the moisture imparting step may not have to contain the water-soluble polysaccharide.

According to the sheet manufacturing method, since the viscosity of moisture does not increase, it is possible to impart moisture to the web with a simpler apparatus.

The sheet manufacturing apparatus includes a mixing portion that mixes a fiber and a water-soluble polysaccharide to form a mixture, a web forming portion that forms a web by accumulating the mixture in a dry manner, a moisture imparting portion that imparts moisture to the web, and a pressurizing and heating portion that pressurizes and heats the web to which the moisture is imparted in the moisture imparting portion, in which the pressurizing and heating portion pressurizes and heats at the same time, a configuration in which a pressure higher than a pressure applied to the web in the pressurizing and heating portion is applied to the web, is not provided upstream of the pressurizing and heating portion in a moving direction of the web, and a configuration in which heating to a temperature higher than a temperature for heating the web in the pressurizing and heating portion is imparted to the web is not provided upstream of the pressurizing and heating portion in the moving direction of the web.

According to the sheet manufacturing apparatus, since high pressure is not applied to the web, miniaturization is possible. Further, according to the sheet manufacturing apparatus, by imparting moisture to the web containing the water-soluble polysaccharide and then pressurizing and heating the sheet at the same time, the sheet can be manufactured at a lower pressure and a lower temperature. Further, according to the sheet manufacturing apparatus, by using a water-soluble polysaccharide, it is possible to manufacture a sheet in which a recycled sheet can be easily manufactured. Further, according to the sheet manufacturing apparatus, the amount of water used can be reduced as compared with the wet papermaking method by forming a web by accumulating the mixture in a dry manner.

What is claimed is:

1. A sheet manufacturing apparatus comprising:

a mixing portion having a mixing space in which a fiber and a water-soluble polysaccharide are mixed to form a mixture;

a web forming portion arranged disposed downstream of the mixing portion, and including an accumulation surface to form a web by accumulating the mixture on the accumulation surface in a dry manner;

a moisture imparting portion arranged downstream of the web forming portion to uniformly impart moisture to the web in the form of one of water vapor, mist, shower and ink jet, so that a water content of the web to which the moisture is imparted is 12% by mass or more and 40% by mass or less; and a pressurizing and heating portion including a pressurizing and heating surface that simultaneously pressurizes and heats the web to which the moisture is imparted in the moisture imparting portion, a pressure applied to the web being 0.2 MPa or more and 10 MPa or less.

* * * * *